US006215882B1

(12) United States Patent
Heron

(10) Patent No.: US 6,215,882 B1
(45) Date of Patent: Apr. 10, 2001

(54) PANEL-FORM LOUDSPEAKER

(75) Inventor: Kenneth H Heron, Farnborough (GB)

(73) Assignee: The Secretary of State for Defence, Hants (GB)

( * ) Notice: Subject to any disclaimer, the term of this patent is extended or adjusted under 35 U.S.C. 154(b) by 0 days.

(21) Appl. No.: 09/308,924

(22) PCT Filed: Dec. 8, 1997

(86) PCT No.: PCT/GB97/03383

§ 371 Date: May 27, 1999

§ 102(e) Date: May 27, 1999

(87) PCT Pub. No.: WO98/26630

PCT Pub. Date: Jun. 18, 1998

(30) Foreign Application Priority Data

Dec. 11, 1996 (GB) ..... 9625731

(51) Int. Cl.[7] ..... H04R 25/00

(52) U.S. Cl. ..... 381/152; 381/396; 381/423; 381/431; 181/148; 181/167

(58) Field of Search ..... 381/152, 396, 381/423, 431, 338, FOR 153, FOR 162, FOR 163; 181/148, 167, 173, 199

(56) References Cited

U.S. PATENT DOCUMENTS

| | | | | |
|---|---|---|---|---|
| 3,187,116 | | 6/1965 | Sears et al. . | |
| 3,247,925 | | 4/1966 | Warnaka . | |
| 3,272,281 | | 9/1966 | Rutters . | |
| 3,347,335 | | 10/1967 | Watters et al. . | |
| 3,848,090 | * | 11/1974 | Walker | 381/152 |
| 4,198,550 | | 4/1980 | Matsuda et al. . | |
| 4,271,498 | | 6/1981 | Zafferri et al. . | |
| 4,272,653 | | 6/1981 | Osato et al. . | |
| 4,291,205 | | 9/1981 | Kamon et al. . | |
| 4,300,655 | | 11/1981 | Sakamoto et al. . | |
| 4,322,583 | | 3/1982 | Maeda . | |
| 4,385,210 | | 5/1983 | Marquiss . | |
| 4,392,027 | | 7/1983 | Bock . | |
| 4,408,678 | | 10/1983 | White, Jr. . | |
| 4,700,396 | * | 10/1987 | Bolin | 381/152 |
| 4,720,867 | * | 1/1988 | Imai et al. | 381/152 |
| 5,638,456 | * | 6/1997 | Conley et al. | 381/152 |
| 6,058,196 | * | 5/2000 | Heron | 381/152 |

FOREIGN PATENT DOCUMENTS

| | | | |
|---|---|---|---|
| 0 114 910 | 8/1984 | (EP) . | |
| 2 408 168 | 6/1979 | (FR) . | |
| 931 080 | 7/1963 | (GB) . | |
| 2 010 637 | 6/1979 | (GB) . | |
| 2 023 375 | 12/1979 | (GB) . | |
| 2 115 646 | 9/1983 | (GB) . | |
| 2 262 861 | 6/1993 | (GB) . | |
| 3-083493 | 4/1991 | (JP) . | |
| 4-157900 | 5/1992 | (JP) . | |
| 6-30488 | 3/1994 | (JP) . | |
| 1658421 | 6/1991 | (SU) . | |
| WO 91 01186 | 2/1991 | (WO) | B21D/47/00 |
| WO 92 03024 | 2/1992 | (WO) | H04R/9/00 |
| WO 95 24815 | 9/1995 | (WO) | H04R/9/00 |

OTHER PUBLICATIONS

Rossing, Thomas D. et al, "Nonlinear Vibrations in Plates and Gongs", Journal of the Acoustical Society of America, vol. 73, No. 1, Jan. 1983, pp. 345–351.

Waterhouse, Richard V. et al, "Sampling Statistics for Vibrating Rectangular Plates", Journal of the Acoustical Society of America, vol. 72, No. 6, Dec. 1982, pp. 1863–1869.

* cited by examiner

*Primary Examiner*—Stella Woo
*Assistant Examiner*—Suhan Ni
(74) *Attorney, Agent, or Firm*—Nixon & Vanderhye P.C.

(57) ABSTRACT

To overcome acoustic distortion caused by local resonance in panel core cells, a resonant multi-mode radiator element is provided for a panel form loudspeaker with a functional upper frequency limit $f_{max}$. The element has skins and a cellular based core, the skins have a thickness h, a Young's modulus E a Poisson's ratio of ν and a material density ρ and the core has a cell size lcell characterized in that the cell size lcell is less than equation (2).

3 Claims, 1 Drawing Sheet

PANEL-FORM LOUDSPEAKER

BACKGROUND OF THE INVENTION

1. Field of the Invention

This invention relates to resonant multi-mode radiator elements for panel-form loudspeakers. In particular, resonant multi-mode radiator elements which can improve the sound quality of such speakers by reducing the occurrence of air resonance within the functional bandwidth of the speaker are considered.

2. Discussion of the Prior Art

U.S. Pat. No. 3,247,925 discloses a low frequency panel-form loudspeaker which operates by exciting bending waves in a lightweight, stiff panel which remains essentially stationary but for the bending waves. Such radiating panels may comprise skinned composites with honeycomb or similar shaped cellular cores.

Acoustic distortion may occur in panel form loudspeakers where air resonance occurs in the core of the panel. Patent application No. PCT/GB91/01262 discloses how this form of acoustic distortion can be reduced by ensuring that the frequency at which the first air resonance occurs within the core of the panel is above the functional upper frequency limit of the loudspeaker. This frequent $f_{core}$ is a function of the speed of sound in air, c and the depth of the panel, d as follows;

$$f_{core}=c/2\cdot d$$

This expression fixes the depth of the panel core according to the desired functional frequency bandwidth of the loudspeaker, the desired functional upper frequency limit, $f_{max}$, of the loudspeaker being inversely proportional to the panel depth.

It can be shown that a second level of acoustic distortion occurs in panel-form loudspeakers at certain frequencies within the panel, when a localised resonance occurs in the skin immediately above individual core cells. The effect of this localised skin resonance is to reduce the effective bending stiffness of the panel speaker and consequently the radiation efficiency of the panel.

SUMMARY OF THE INVENTION

This invention provides a resonant multi-mode radiator element for a panel form loud speaker having a functional upper frequency limit $f_{max}$, the element having skins and a cellular based core, the skins having a thickness h, a Young's modulus E a Poisson's ratio of ν and a material density ρ, and the core having a cell size $l_{cell}$ characterised in that the $l_{cell}$ size is less than:

$$\sqrt{\frac{\pi h}{4f_{max}}\left(\frac{E}{3\rho(1-\nu 2)}\right)^{\frac{1}{2}}}$$

BRIEF DESCRIPTION OF THE DRAWINGS

The invention is described below by way of example, with reference to the drawings of which.

DETAILED DISCUSSION OF PREFERRED EMBODIMENTS

Figure 1:
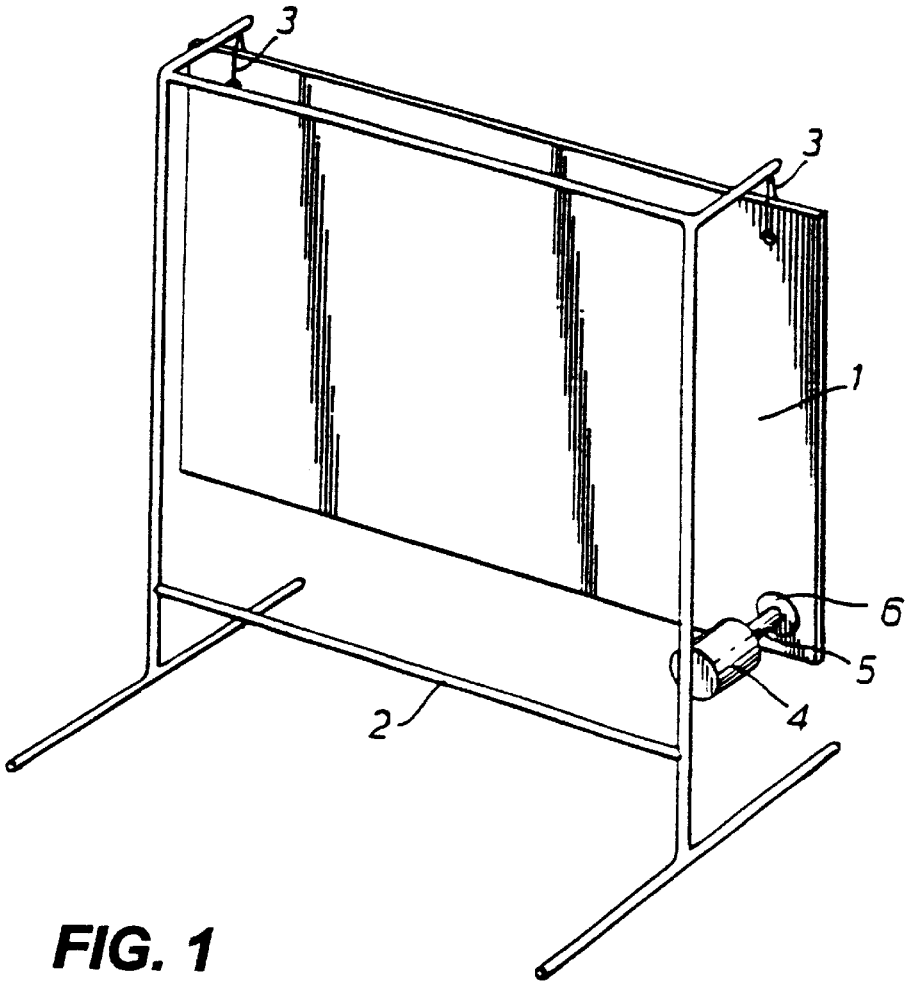
FIG. 1 is an isometric view from the rear of a frame-mounted loudspeaker.

The loudspeaker as illustrated in FIG. 1 comprises a resonant multi-mode radiator 1, a simple support frame 2 from which the radiator is suspended by means of suspension loops 3, and an electromechanical exciter 4. The radiator 1 comprises a rectangular panel of aluminum alloy-skinned, aluminum alloy honeycomb sandwich construction. Details of the panel and sizing rules etc. are given later. The electromagnetic exciter 4 has a shaft 5 and is mounted upon the support frame 2 such that this shaft 5 bears against the rear of the radiator panel 1 and excites the latter by a reciprocating movement of the shaft when an electrical signal is supplied to the exciter 4. At the point of contact between the shaft 5 and the panel the latter is reinforced by a patch 6 to resist wear and damage.

Figure 2:
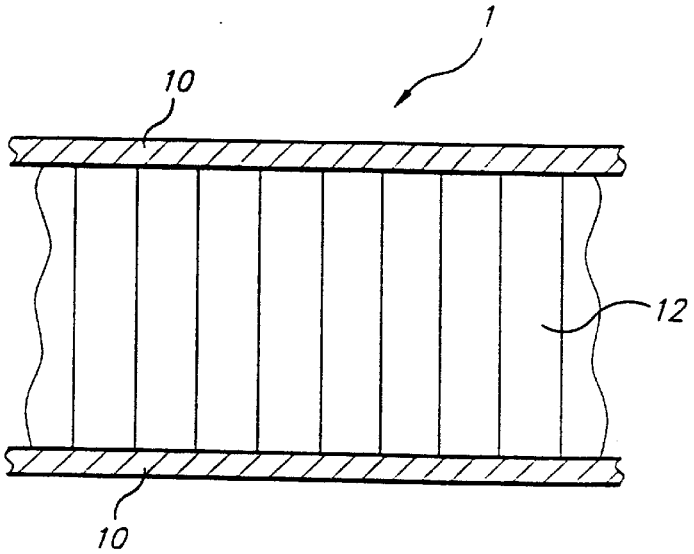
FIG. 2 is a side cross-sectional view of the panel sandwich.

FIG. 2 illustrates the construction of panel 1 having material skins 10 which sandwich a transverse cellular core 12.

It can be shown that the first resonance frequency for an individual skin $f_{skin}$ can be predicted by matching the skin bending wavelength with twice the cell size of the core. Thus for a bending stiffness $B_{skin}$, a mass per unit area $m_{skin}$ and cell size $l_{cell}$ the first resonance frequency of a skin $f_{skin}$ can be defined by;

$$f_{skin}=\frac{\pi}{2l_{cell}^2}\sqrt{\frac{B_{skin}}{m_{skin}}}$$

For an isotropic skin of thickness h with a Young's modulus of E, a Poisson's ratio of ν and a material density of ρ, this becomes:

$$f_{skin}=\frac{\pi h}{4l_{cell}^2}\sqrt{\frac{E}{3\rho(1-\nu^2)}} \qquad \text{Equation (1)}$$

Thus, by choosing a core cell size to ensure that $f_{skin}$ is greater than the functional upper frequency limit $f_{max}$ the loud speaker, the resonance effect is substantially reduced. Rearranging equation (1) and relating to the functional upper frequency limit of the panel form loud speaker, a suitable cell size $l_{cell}$ is predicted from the equation:

$$l_{cell}\leq\sqrt{\frac{\pi h}{4f_{max}}\left(\frac{E}{3\rho(1-\nu^2)}\right)^{\frac{1}{2}}} \qquad \text{Equation (2)}$$

Reduction of cell size can therefore provide improved sound quality by taking the first resonance frequency of the skin outside the functional bandwidth of the speaker. As this frequency is inversely proportional to the square of the cell size, considerable improvements can be obtained with small variations in the cell size.

A further aspect of the invention provides a panel-form loudspeaker containing a multi-mode radiator element as described hereinabove. The loudspeaker further comprising a mounting means which supports the radiator element or attaches it to a supporting body, in a free undamped manner; and an electromechanical drive means coupled to the panel which serves to excite a multi-modal resonance in the radiator element in response to an electrical input within the functional frequency band of the loud speaker.

Preferably the loud speaker will also be characterised in that no planform dimension is less than half the bending wavelength at the lowest functional frequency limit of the loud speaker.

Although in describing a radiator and speaker in accordance with the invention, the term "loud speaker" is used as a convenient nomenclature, it will be understood this should not be read as suggesting any limitation to, say, hi-fi speakers alone. Rather, the invention is applicable across a range of speaker sizes from the smaller scale to the very large for use, for example, in large scale public address systems.

A particular panel core of this invention is illustrated below by way of example with reference to a panel core comprising a 0.5 m×0.5 m square of aluminium skinned, aluminium honeycomb cored composite. The core depth is 0.02 m and the thickness of each skin is 0.003 m. For Aluminium, $E=7\times10^{10}$, $\rho=2700$ and $\nu=0.3$ (mks units), thus $$\sqrt{\frac{E}{3\rho(1-\nu^2)}}$$

approximately equals 3081.7 m/s. Assuming the desired upper frequency limit to be 28 kHz, and applying equation (2) above, the maximum desirable size for $l_{cell}$ becomes approximately 0.016 m.

What is claimed is:

1. A resonant multi-mode radiator element for a panel form loud speaker with a functional upper frequency limit $f_{max}$, the element having skins and a cellular based core, the skins having a thickness h, a Young's modulus E a Poisson's ratio of ν and a material density ρ, and the core having a cell size $l_{cell}$ characterised in that the cell size $l_{cell}$ is less than:

$$\sqrt{\frac{\pi h}{4f_{max}}\left(\frac{E}{3\rho(1-\nu 2)}\right)^{\frac{1}{2}}}.$$

2. A panel-form loudspeaker comprising a multi-mode radiator element; a mounting means which supports the element or attaches it to a supporting body in a free undamped manner, and an electro mechanical drive means coupled to the element which serves to excite a multi-modal resonance in the radiator panel in response to an electrical input within a functional frequency band for the loud speaker characterised in that the multi-mode radiator element is a multi-mode radiator element as claimed in claim 1.

3. A panel-form loudspeaker as claimed in claim 2 characterised in that no planform dimension is less than half the bending wavelength at the lower functional frequency limit of the loudspeaker.

* * * * *

UNITED STATES PATENT AND TRADEMARK OFFICE

CERTIFICATE OF CORRECTION

PATENT NO. : 6,215,882 B1
DATED : April 10, 2001
INVENTOR(S) : Heron

It is certified that error appears in the above-identified patent and that said Letters Patent is hereby corrected as shown below:

Column 1,
Line 55, the equation should read:

$$\sqrt{\frac{\pi h}{4 f_{max}}\left(\frac{E}{3\rho\left(1-\nu^2\right)}\right)^{\frac{1}{2}}}$$

Column 4,
Line 5, the equation should read:

$$\sqrt{\frac{\pi h}{4 f_{max}}\left(\frac{E}{3\rho\left(1-\nu^2\right)}\right)^{\frac{1}{2}}}$$

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*